US011346562B1

(12) United States Patent
Murdock

(10) Patent No.: US 11,346,562 B1
(45) Date of Patent: May 31, 2022

(54) SAFETY GATE FOR A STOVE

(71) Applicant: Dylan Murdock, Atwood, TN (US)

(72) Inventor: Dylan Murdock, Atwood, TN (US)

( * ) Notice: Subject to any disclaimer, the term of this patent is extended or adjusted under 35 U.S.C. 154(b) by 245 days.

(21) Appl. No.: 16/716,663

(22) Filed: Dec. 17, 2019

(51) Int. Cl.
*F24C 15/36* (2006.01)
*F24C 15/10* (2006.01)

(52) U.S. Cl.
CPC ..... *F24C 15/36* (2013.01); *F24C 15/10* (2013.01)

(58) Field of Classification Search
CPC ..... F24C 15/36; F24C 15/10
USPC ..... 126/201
See application file for complete search history.

(56) References Cited

U.S. PATENT DOCUMENTS 4,517,955 A 5/1985 Ehrlich
4,527,540 A * 7/1985 Ryan ..... F24C 15/36 126/201
5,842,464 A 12/1998 Koch
10,890,337 B1 * 1/2021 Arbogast ..... F24C 15/36
2007/0176158 A1 * 8/2007 Robinson ..... E01F 13/028 256/12.5
2019/0063018 A1 * 2/2019 Reiner ..... B65H 75/4471

* cited by examiner

*Primary Examiner* — Avinash A Savani
(74) *Attorney, Agent, or Firm* — Sanchelima & Associates PA; Christian Sanchelima; Jesus Sanchelima

(57) ABSTRACT

A stove guard having a blanket assembly and a support assembly is disclosed herein. The stove guard includes a flexible fire blanket material that may be arranged in a plurality of configurations including a retractable blind coupled to a stove vent or microwave mounted above the stove. The device may also feature a two-part retractable fencing drawn together from each side of the stove top and coupled in the center and a single fence that may couple to a vertical support held in place with suction cups on either side of the stove top. Each of the devices may be configured to provide an added security measure useful for preventing small children from gaining access to the hot surfaces and may also provide an emergency fire extinguishing blanket in the event of an unexpected fire.

13 Claims, 5 Drawing Sheets

SAFETY GATE FOR A STOVE

BACKGROUND OF THE INVENTION

1. Field of the Invention

The present invention relates to a stove safety guard and, more particularly, to a stove safety guard that is made of a flexible fire blanket arranged in a plurality of configurations mounted to a vertical support.

2. Description of the Related Art

Several designs for a stove safety guard have been designed in the past. None of them, however, include a flexible fire blanket material that may be arranged in a plurality of configurations including a retractable blind coupled to a stove vent or microwave mounted above the stove. The device may also feature a two-part retractable fencing drawn together from each side of the stove top and coupled in the center and a single fence that may couple to a vertical support held in place with suction cups on either side of the stove top. Each of the devices may be configured to provide an added security measure useful for preventing small children from gaining access to the hot surfaces and may also provide an emergency fire extinguishing blanket in the event of an unexpected fire. It is known that parents often have a need to take preventative measures to ensure that a child does not touch a hot stove. However, if a guardian is not present in the presence of a hot stove a child may out of curiosity, attempt to touch the hot stove. As a result, a child may find themselves burned due to a lack of safety precautions. The present invention provides the necessary safety precautions needed to effectively operate a stovetop.

Applicant believes that a related reference corresponds to U.S. Pat. No. 5,842,464 issued for a stove safety guard system. Applicant believes that another reference relates to U.S. Pat. No. 4,517,955 issued for a stove safety guard comprising a barrier system for the top of a range along one or more sides of a stove top including a barrier member on each side. However, these references differ from the present invention because they fail to address the flexible fireproof blanket configured to form a stove guard for the stovetop. Additionally, the references collectively fail to address the retractable stove top barriers and fire proof blankets in functional combination. The present invention addresses these issues by providing a stove guard having a flexible fireproof blanket in addition to vertical supports that are mounted on a stove top in a variety of ways. Furthermore, the present invention provides the most effective method for providing protection to individuals who might burn themselves when coining in contact with a hot stove top.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a stove guard to serve as safety mechanism used to prevent people from pulling down or touching hot products that are on the stove.

It is another object of this invention to provide a stove guard that is a gate mounted on a stove top that creates a barrier between an individual and the hot areas of the stove top.

It is still another object of the present invention to provide a stove guard that is provided in a variety of implementations to fit a user's need.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
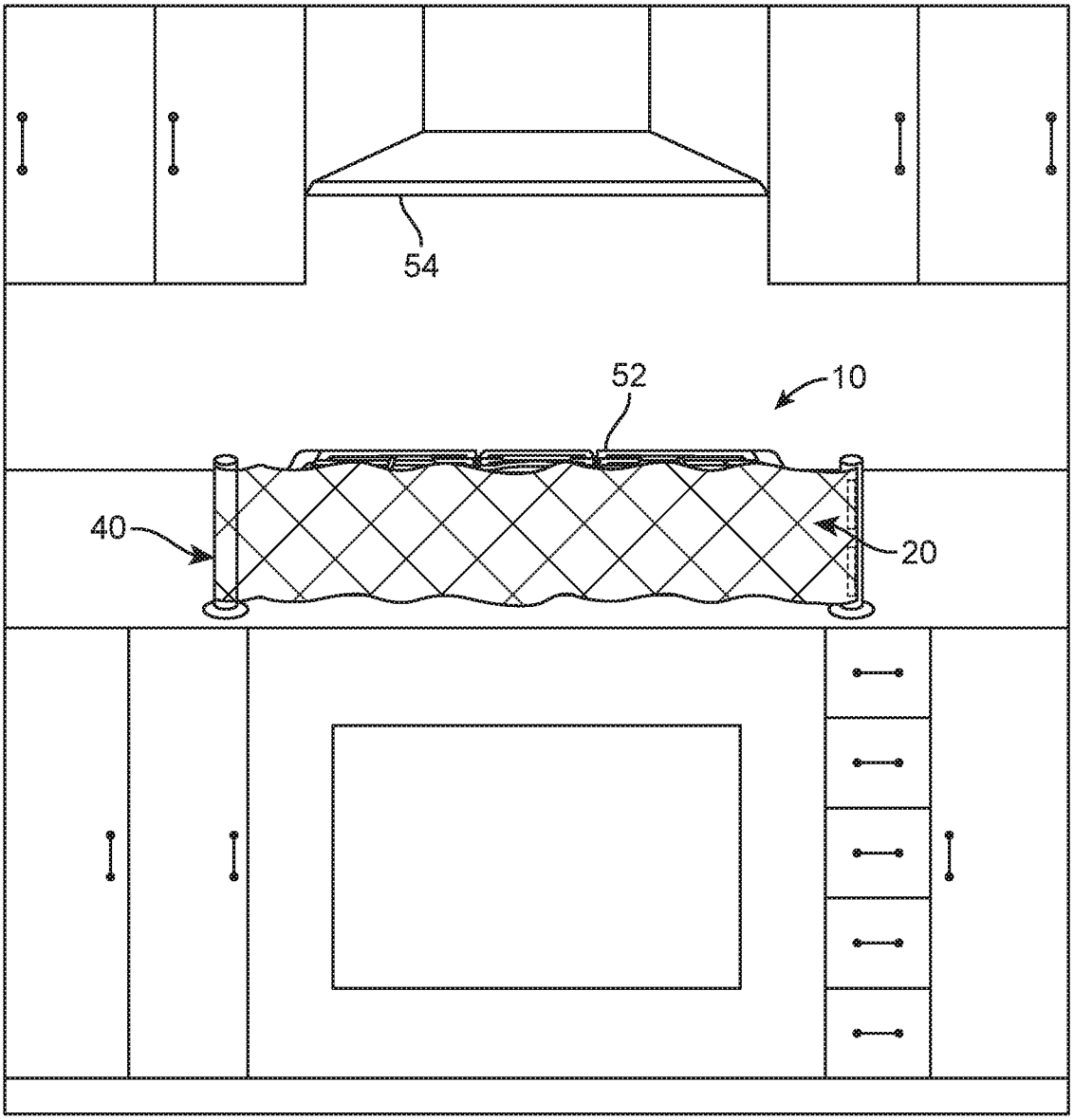
FIG. 1 represents a view of stove guard 10 in its operational setting mounted to a stovetop 52 in accordance to and embodiment of the present invention.
Figure 2:
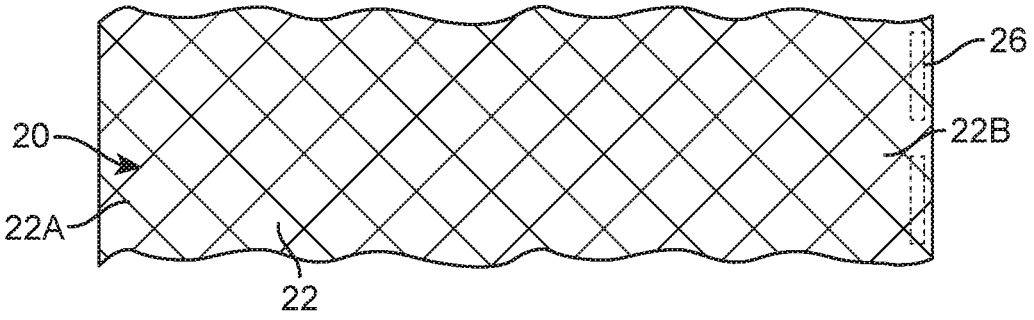
FIG. 2 shows an isometric view of blanket assembly 20 in accordance to an embodiment of the present invention.
Figure 3:
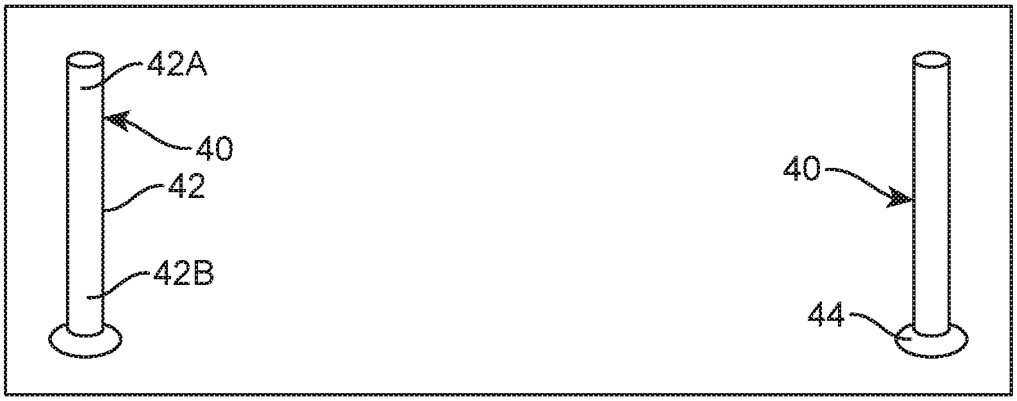
FIG. 3 illustrates an isometric view of support assembly 40 in accordance to an embodiment of the present invention.
Figure 4:
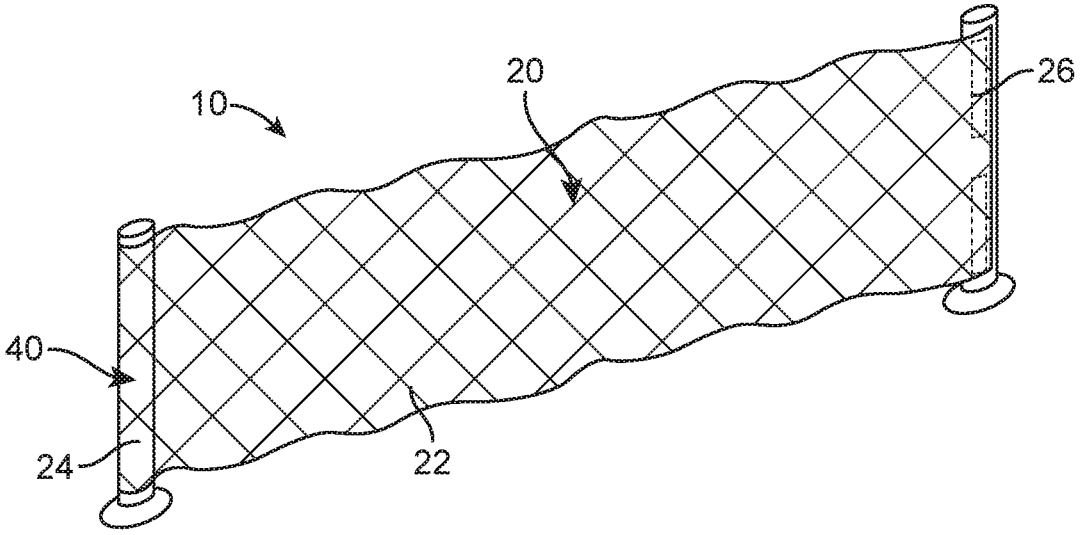
FIG. 4 is a representation of blanket assembly 20 mounted onto support assembly 40 in accordance to an embodiment of the present invention.
Figure 5:
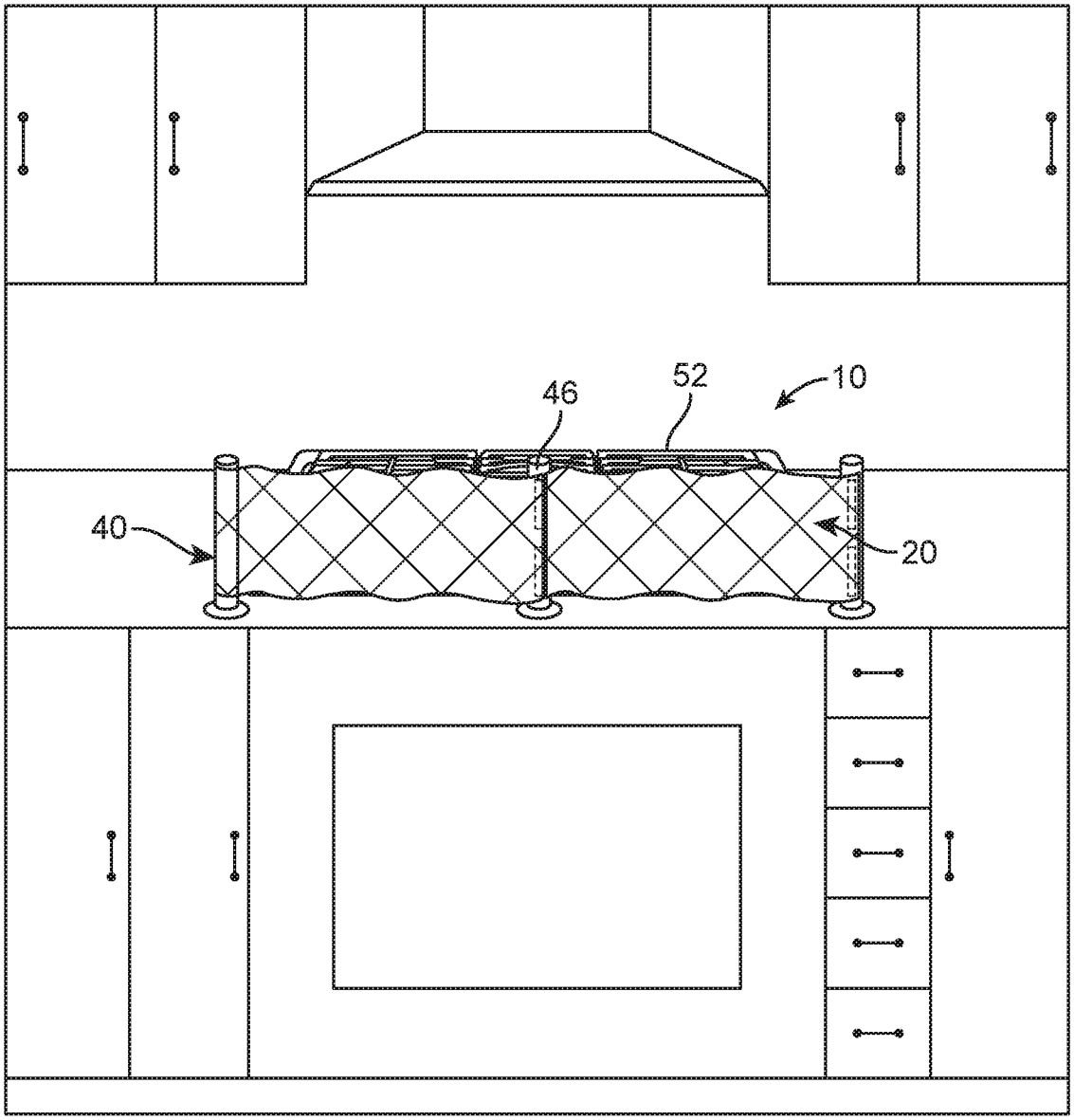
FIG. 5 shows a view of stove guard 10 in its operational setting mounted to a stovetop 52 and further including center vertical support 46 in accordance to another embodiment of the present invention.
Figure 6:
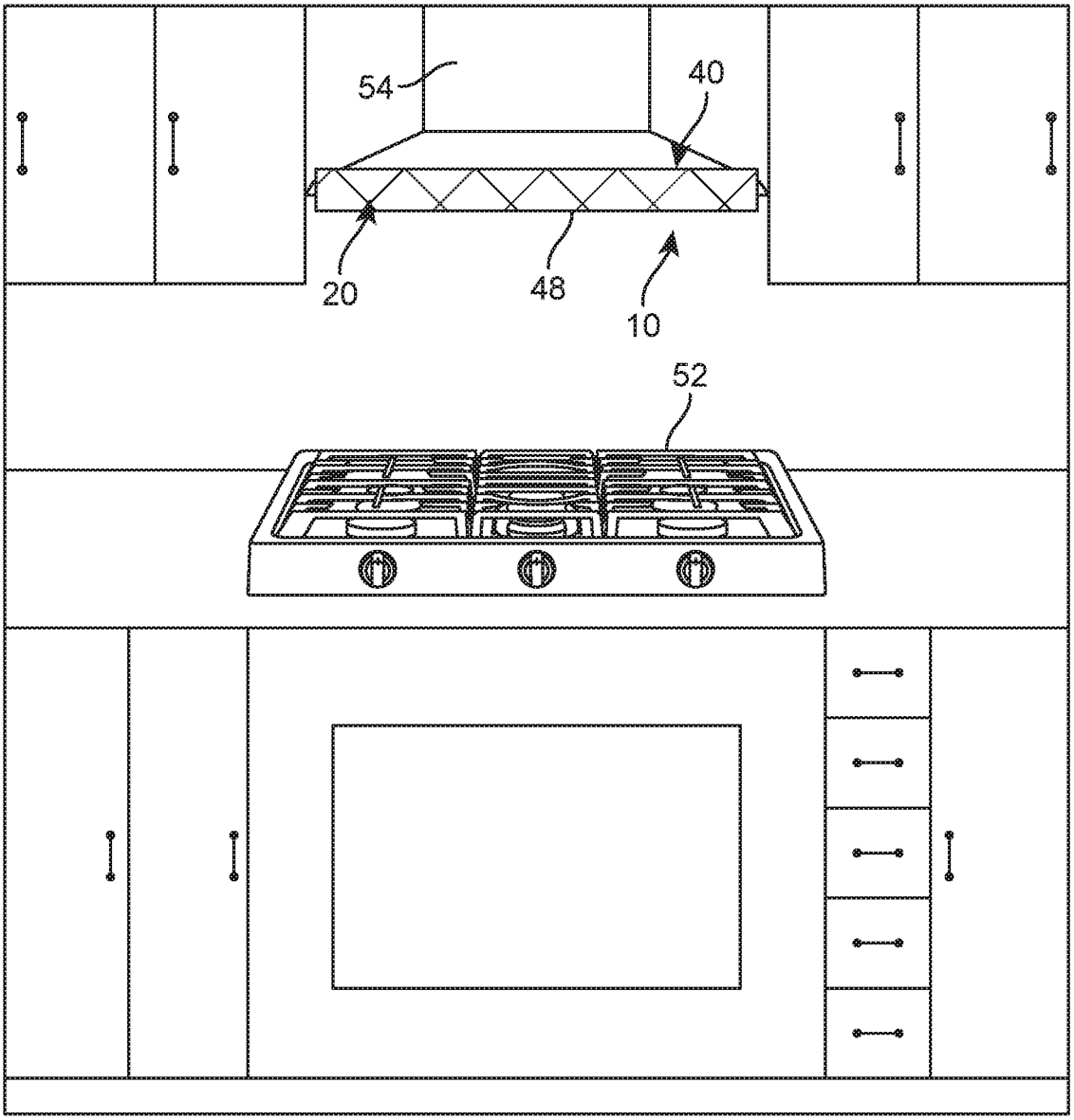
FIG. 6 illustrates a view of stove guard 10 in its operational setting having retractable blind 48 mounted to a stove vent 54 in accordance to yet another embodiment of the present invention.
Figure 7:
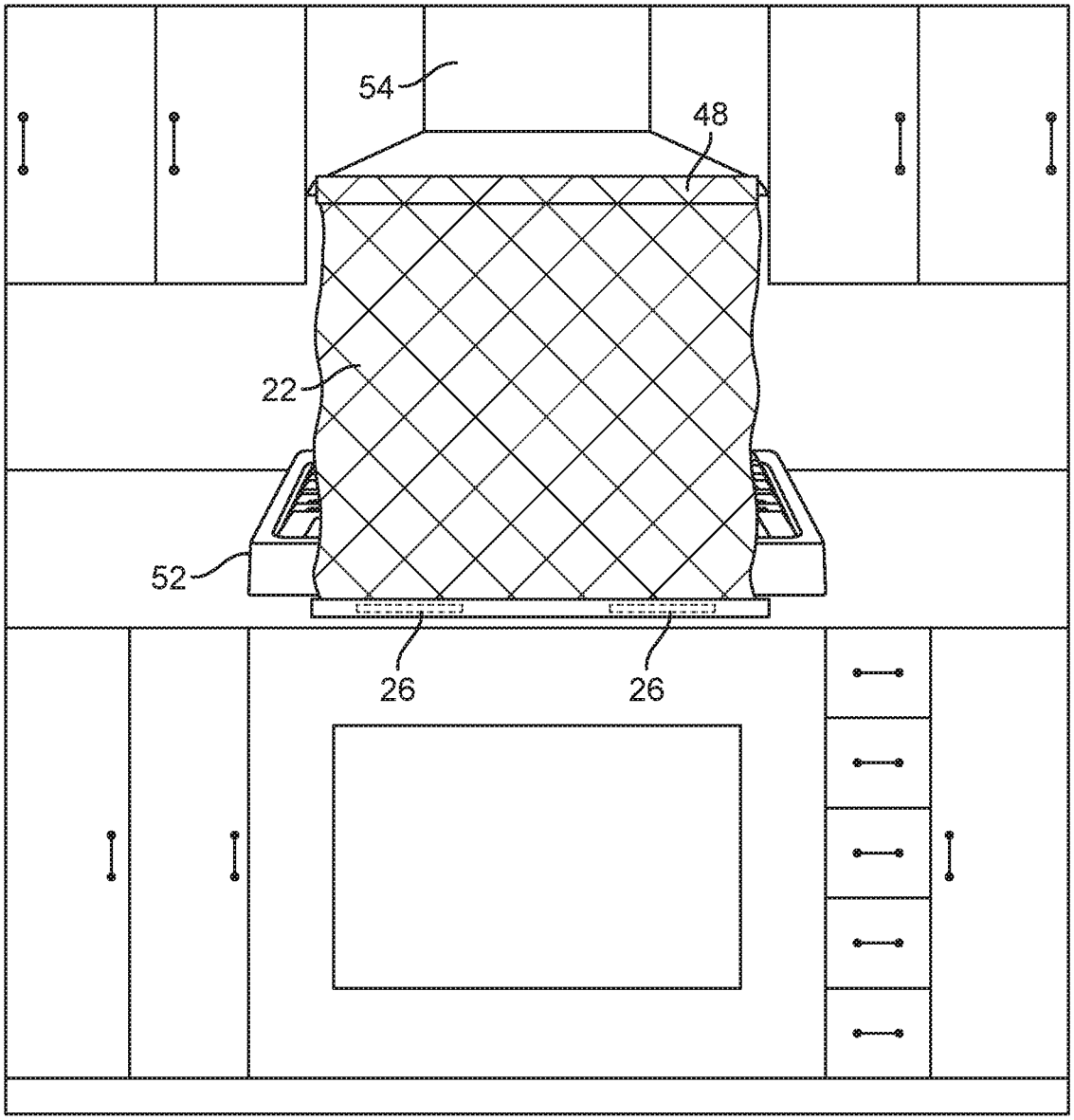
FIG. 7 represents a view of stove guard 10 in its operational setting having flexible fire blanket 22 retracted from retractable blind 48 and mounted to stovetop 52 in accordance to yet another embodiment of the present invention.

Referring now to the drawings, where the present invention is generally referred to with numeral 10, it can be observed a stove guard 10 having a blanket assembly 20, support assembly 40, and a stovetop 52.

Blanket assembly 20 includes a flexible fire blanket 22 including a first end 22A and a second end 22B. In one embodiment, flexible fire blanket 22 may be rectangular in shape and have a predetermined perimeter. Additionally, flexible fire blanket 22 may be made of a suitable fire-retardant material that is configured to easily extinguish fires. It should be understood that any suitable fire-retardant material may be used for flexible fire blanket 22 such as but not limited to fire resistant wool materials. First end 22A of flexible fire blanket 22 may include a cloth loop 24 located thereon. In one embodiment, cloth loop 24 may be an integral part of flexible fire blanket 22. Cloth loop 24 may be made of the same material as flexible fire blanket 22 and integrally stitched thereon. Additionally, cloth loop 24 may further have a cylindrical hollow portion therein. Cloth loop 24 may be mounted vertically along a side of flexible fire blanket 22. Other embodiments may include cloth loop 24 mounted in other variations along flexible fire blanket 22. Flexible fire blanket 22 may further include mounting members 26 mounted along an edge of flexible fire blanket 22. In one embodiment, this edge may be opposite to the one having cloth loop 24. Additionally, mounting members 26 may be of any suitable mounting members known in the art of attachment. In one embodiment, mounting members 26 are rectangular magnets mounted along an edge of flexible fire blanket 22. These magnets allow flexible fire blanket 22 to be mounted securely on to a structure. It should be understood, other mounting members may be used for mounting members 26 such as but not limited to clips, adhesives, and the like.

In another embodiment, more than one flexible fire blanket 22 may be provided for use with stovetop 52. It should be understood that any number of flexible fire blanket 22 may be used for stove guard 10. Additionally, flexible fire blanket 22 may be cut to a suitable length to cover an entire front end of stovetop 52.

Support assembly 40 includes vertical supports 42 having a top end 42A and a bottom end 42B. In one embodiment, vertical supports 42 are uniform cylindrical rods extending a predetermined height. Additionally, vertical supports 42 may be made of a suitable metallic material configured to receive a magnet. It should be understood, that other embodiments may include vertical supports 42 being other support mechanisms other than cylindrical rods. Bottom end 42B of vertical supports 42 further include an attachment member 44 mounted thereon. In one embodiment, attachment member 44 may be a suction cup. Other embodiments may include attachment member 44 as being different variations such as adhesives, fasteners, and the like. Vertical supports 42 may be mounted in a vertical position mounted upwardly from stovetop 52. In one embodiment, vertical supports 42 are mounted on a left end and a right end of a front side of stovetop 52. Additionally, flexible fire blanket 22 is then mounted to vertical supports 42. Cloth loop 24 may be received by top end 42A of one of cloth loops 24 of flexible fire blanket 22. Additionally, mounting members 26 are then mounted to another one of vertical supports 42 located at another end of a front side of stovetop 52. In one embodiment, the magnetic mounting members are communicably attached to the outer surface area of vertical supports 42 due to their metallic nature. As a result, a secure attachment is created between blanket assembly 20 and support assembly 40. A gate like structure is then created in a front end of stovetop 52. This gate like structure prevents children from coining into contact with a hot stove eye located on stovetop 52. Additionally, in the event that a fire occurs on stovetop 52, a user may then easily remove blanket assembly 20 form support assembly 40. The user may then user flexible fire blanket 22 to extinguish the fire. The fire-retardant nature of flexible fire blanket 22 allows a user to effectively extinguish the fire. In one embodiment, when stove guard 10 is not in use, a user may then store flexible fire blanket 22 in a rolled configuration on one of vertical supports 42.

In one embodiment, support assembly 40 includes a center vertical support 46 positioned in a center portion of a front end of stovetop 52. Center vertical support additionally includes mounting members 26 just as vertical supports 22. In this embodiment, more than one of flexible fire blanket 22 may be used for stove guard 10. A user may mount a flexible fire blanket 22 to each of vertical supports 42 located on a left end and a right end of a front side of stovetop 52. Afterwards, each of flexible fire blanket 22 may then be extended towards the middle of stovetop 52 and then mounted onto center vertical support 46 found thereon. Mounting members 26 securely attach to center vertical support 46 to create a secure attachment.

In yet another embodiment, support assembly 40 further includes a retractable blind 48 mounted to a stove vent 54 located on top of stovetop 52. Retractable blind 48 may be a rectangular hollow structure configured to house flexible fire blanket 22 therein. Additionally, retractable blind 48 may be mounted onto stove vent 54 using known means in the art such as welding, fasteners, and the like. When a user desires to engage stove guard 10 he may then retract flexible fire blanket 22 from the retractable blind 48. Mounting members 26 of flexible fire blanket 22 are then securely attached to a front end of stovetop 52. As a result, stove guard 10 is engaged and covers an entire front end of stovetop 52. Additionally, children are kept safe from coining into contact with hot surfaces and objects located on stovetop 52. In yet another embodiment of the present invention, retractable blind 48 may be mounted to a front end of stovetop 52. A user may then retract flexible fire blanket 22 from retractable blind 48 and then securely mount it to stove vent 54 through means of mounting members 26. Stove guard 10 provides a user the most optimal method to give a user safety and peace of mind around a kitchen environment.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a stove guard, comprising:

a. an oven having a stovetop;

b. a blanket assembly including a flexible fire blanket having a perimeter, wherein said flexible fire blanket is rectangular in shape, wherein said flexible fire blanket extends the entire length of said stovetop, wherein said flexible fire blanket further includes a cloth loop located in a vertical position at a first end of said flexible fire blanket, wherein said cloth loop includes a cylindrical hollow portion therein, wherein said flexible fire blanket further includes mounting members located at a second end of said flexible fire blanket, wherein said mounting members are magnets; and c. a support assembly including vertical supports being cylindrical rods, wherein said vertical supports include a top end and a bottom end, wherein said bottom end of said vertical supports include an attachment member, wherein said vertical supports are mounted vertically on a top surface of said stove top, wherein said cloth loop of said flexible fire blanket is received by a top end of one of said vertical supports, wherein said flexible fire blanket then extends across the length of said stove stovetop, wherein said mounting members are received by an outer surface of one said vertical supports to be securely mounted thereon.

2. The system for a stove guard of claim 1 wherein said flexible fire blanket extends a pre-determined height above said stovetop.

3. The system for a stove guard of claim 1 wherein said attachment member is a suction cup.

4. The system for a stove guard of claim 1 wherein said vertical supports are made of a metallic material.

5. The system for a stove guard of claim 1 wherein said flexible fire blanket is stored in a rolled configuration on one of said vertical supports.

6. The system for a stove guard of claim 1 wherein said vertical supports are located at a left side and a right side of a front end of said stovetop.

7. The system for a stove guard of claim 1 wherein said mounting members are stacked vertically on top of each other and separated by a predetermined distance.

8. A system for a stove guard, comprising:

a. an oven having a stovetop and a stove vent;

b. a blanket assembly including flexible fire blankets having a perimeter, wherein said flexible fire blankets are rectangular in shape, wherein said flexible fire blankets extend the entire length of said stovetop, wherein said flexible fire blankets further include a cloth loop located in a vertical position at a first end of said flexible fire blankets, wherein said cloth loop includes a cylindrical hollow portion therein, wherein said flexible fire blanket further includes mounting members located at a second end of said flexible fire blanket, wherein said mounting members are magnets; and c. a support assembly including vertical supports being cylindrical rods, wherein said vertical supports include a top end and a bottom end, wherein said bottom end of said vertical supports include an attachment member, wherein said vertical supports are mounted vertically on a top surface of said stove top, wherein said cloth loop of said flexible fire blankets are received by said top end of said vertical supports, wherein said support assembly further includes a center vertical support positioned in a center front end of said stove top, wherein said flexible fire blankets extend from each end of said stove top and are mounted to said center vertical support, wherein said mounting members are received by said center vertical support and are securely mounted thereon.

9. The system for a stove guard of claim 8 wherein said flexible fire blankets extend a pre-determined height above said stovetop.

10. The system for a stove guard of claim 8 wherein said attachment member is a suction cup.

11. The system for a stove guard of claim 8, wherein said support assembly further includes a retractable blind coupled in a horizontal position across said stove vent, wherein said flexible fire blanket is housed within said retractable blind.

12. The system for a stove guard of claim 11, wherein said flexible fire blanket is pulled down from said retractable blind to cover an entire front end of said stovetop.

13. The system for a stove guard of claim 11, wherein said mounting members are coupled to a front end of said stovetop.

* * * * *